United States Patent [19]

Ishii

[11] Patent Number: 4,737,780

[45] Date of Patent: Apr. 12, 1988

[54] DISPLAY CONTROL CIRCUIT FOR READING DISPLAY DATA FROM A VIDEO RAM CONSTITUTED BY A DYNAMIC RAM, THEREBY REFRESHING MEMORY CELLS OF THE VIDEO RAM

[75] Inventor: Takatoshi Ishii, Tokyo, Japan

[73] Assignee: Tokyo Shibaura Denki Kabushiki Kaisha, Kawasaki, Japan

[21] Appl. No.: 533,003

[22] Filed: Sep. 16, 1983

[30] Foreign Application Priority Data

Sep. 20, 1982 [JP] Japan ..... 57-163424

[51] Int. Cl.[4] ..... G09G 1/14

[52] U.S. Cl. ..... 340/750; 340/748; 340/799

[58] Field of Search ..... 340/747, 748, 750, 789, 340/798, 799

[56] References Cited

U.S. PATENT DOCUMENTS

| | | | |
|---|---|---|---|
| 4,129,859 | 12/1978 | Iwamura et al. . | |
| 4,243,984 | 1/1981 | Ackley et al. | 340/747 |
| 4,356,482 | 10/1982 | Oguchi | 340/799 |
| 4,388,621 | 6/1983 | Komatsu et al. | 340/750 |
| 4,408,200 | 10/1983 | Bradley | 340/750 |
| 4,430,649 | 2/1984 | Leininger | 340/748 |
| 4,482,979 | 11/1984 | May | 340/750 |
| 4,556,879 | 12/1985 | Tanaka | 340/748 |

FOREIGN PATENT DOCUMENTS

| | | |
|---|---|---|
| 2636788 | 2/1978 | Fed. Rep. of Germany . |
| 54-731 | 1/1979 | Japan . |

*Primary Examiner*—Gerald L. Brigance
*Assistant Examiner*—Jeffery A. Brier
*Attorney, Agent, or Firm*—Kenyon & Kenyon

[57] ABSTRACT

A display control circuit comprises dynamic memory chips as a video RAM for storing pattern data or character codes to be displayed on a screen, and a read controller for generating a reading address (including a raster address and a memory address). For refreshing all memory cells for the dynamic memory chips within a predetermined refresh period, the circuit further comprises an address converter for supplying a part of the raster address and a part of the memory address to a row address of the memory chips and for supplying all or a part of the remaining reading address to a column address thereof so that a part of the raster address is assigned to the lower bit location of the row address.

12 Claims, 4 Drawing Sheets

FIG. 2A (ROW)
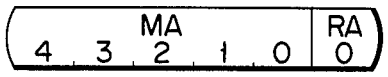
FIG. 2B (COLUMN)
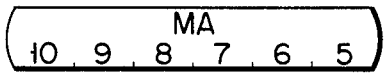
FIG. 3
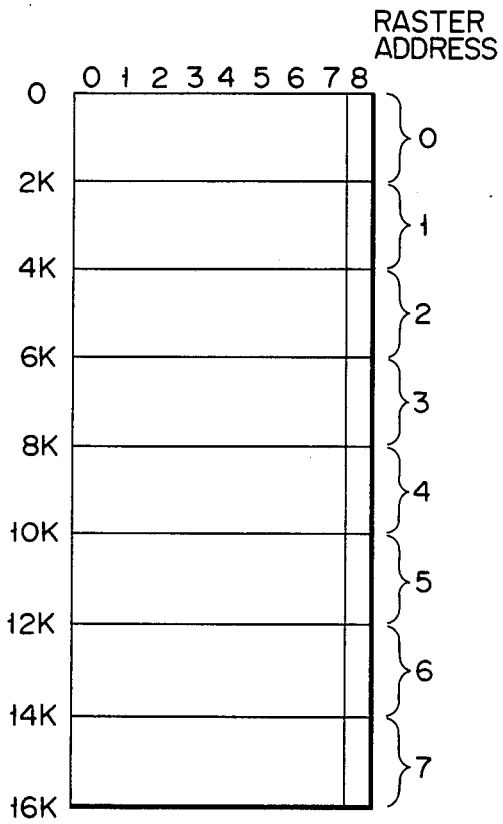
FIG. 4
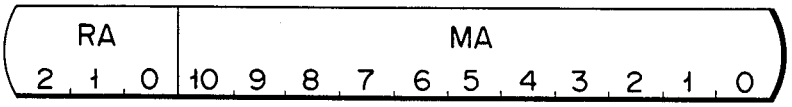

FIG. 6A (ROW)
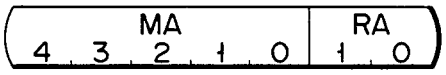
FIG. 6B (COLUMN)
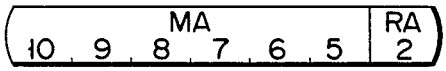
FIG. 7A ($\overline{RAS}$)
FIG. 7B ($\overline{COL}$)
FIG. 7C ($\overline{CAS}$)
FIG. 7D (VRAD)
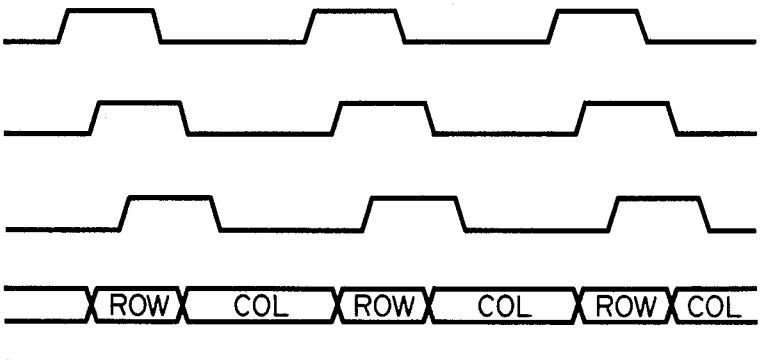
FIG. 8A (ROW)
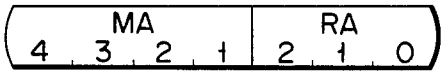
FIG. 8B (COLUMN)
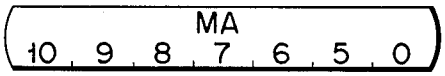

DISPLAY CONTROL CIRCUIT FOR READING DISPLAY DATA FROM A VIDEO RAM CONSTITUTED BY A DYNAMIC RAM, THEREBY REFRESHING MEMORY CELLS OF THE VIDEO RAM

BACKGROUND OF THE INVENTION

This invention relates to a display control circuit which effectively refreshes memory cells of a video RAM constituted by a dynamic RAM.

A CRT control device includes a video RAM. If the video RAM is a dynamic RAM, it is necessary to repeatedly refresh the RAM at predetermined intervals of 2 msec or less. Otherwise, the data stored in the memory cells would be lost.

The memory cells of the dynamic RAM are usually arranged in a matrix form. To read data from, or write it into, one memory cell, a row address and a column address are supplied to the RAM chip. The row address designates the memory cells of one row. Items of data are read from these memory cells and stored in a buffer amplifier (refresh amplifier) provided within the RAM chip. The items of data stored in the buffer amplifier are written back into the memory cells of the row. Therefore, these memory cells on one row are refreshed every time a row address is supplied to the dynamic RAM. And the DRAM as a whole is refreshed after all the row addresses are supplied to the DRAM. In the case of a 4 K bit DRAM having a memory cell matrix of 64 rows by 64 columns, all the memory cells are completely refreshed when all the 64 row addresses are accessed.

The reading of display data from the video RAM is synchronized with the display of the data by the CRT display unit. If the items of data to be displayed are stored in a column of memory cells in the order of reading, the cells can be refreshed when the items of data are read to be displayed. A method of arranging bits forming a character code in the column of memory cells is described in Japanese Patent Disclosure No. 79-731.

This method is effective only for a certain format of the CRT screen in which the number of characters (digits) per display row is relatively large (e.g., 64 or 80 digits) and the number of rasters (scanning lines) per display row (one character) is relatively small (e.g., 8 or 10 rasters). When the CRT screen has 64 digits per row and 10 rasters per row, a time period for displaying one row is 640 μsec if a display period for one raster is 64 μsec. Therefore, three rows can be displayed in 2 msec. Hence, 192 ($=64\times3$) character codes stored in VRAM are accessed within 2 msec. In other words, 192 different row addresses are accessed within 2 msec and a video RAM having less than 192 rows is refreshed within 2 msec.

Therefore, even if the video RAM is a dynamic RAM of 16 Kb (128 bits$\times$128 bits), all memory cells can be refreshed within one refresh cycle of 2 msec.

However, a high-resolution display of characters is required for a personal computer; therefore, the number of rasters per row tends to increase and the number of digits per row tends to decrease. In this case, the prior art method has the following drawbacks. When the screen has 40 digits per row and 20 rasters per row, the period for displaying one row is 1.28 msec. Therefore, only 80 row addresses are accessed within 2.56 msec.

SUMMARY OF THE INVENTION

It is accordingly an object of the invention to provide a display control circuit which shortens a refresh cycle of a video RAM and reliably refreshes the video RAM within a predetermined period of time regardless of the format of the display screen.

According to the invention, there is provided a display control circuit comprising a video RAM for storing data to be displayed on a display screen each row of which comprises several rasters, a read controller for producing a raster address and a memory address to read the data from the video RAM, and a circuit for supplying a row address and a column address which are obtained from the raster address and memory address produced by the read controller so that the raster address is included in the row address supplied to the video RAM.

BRIEF DESCRIPTION OF THE DRAWINGS

FIGS. 2A and 2B respectively show a row address and a column address which are supplied to the video RAM;

FIG. 3 is an address map, or a logical address map of the video RAM according to a second embodiment of the invention;

FIG. 4 shows the logical address of the video RAM according to the second embodiment;

FIGS. 6A and 6B respectively show a row address and a column address which are supplied to the video RAM;

FIGS. 7A and 7D are timing charts illustrating how the video RAM is accessed; and FIGS. 8A and 8B respectively show a row address and a column address according to a modification of the second embodiment.

DETAILED DESCRIPTION OF THE PREFERRED EMBODIMENT

Figure 1:
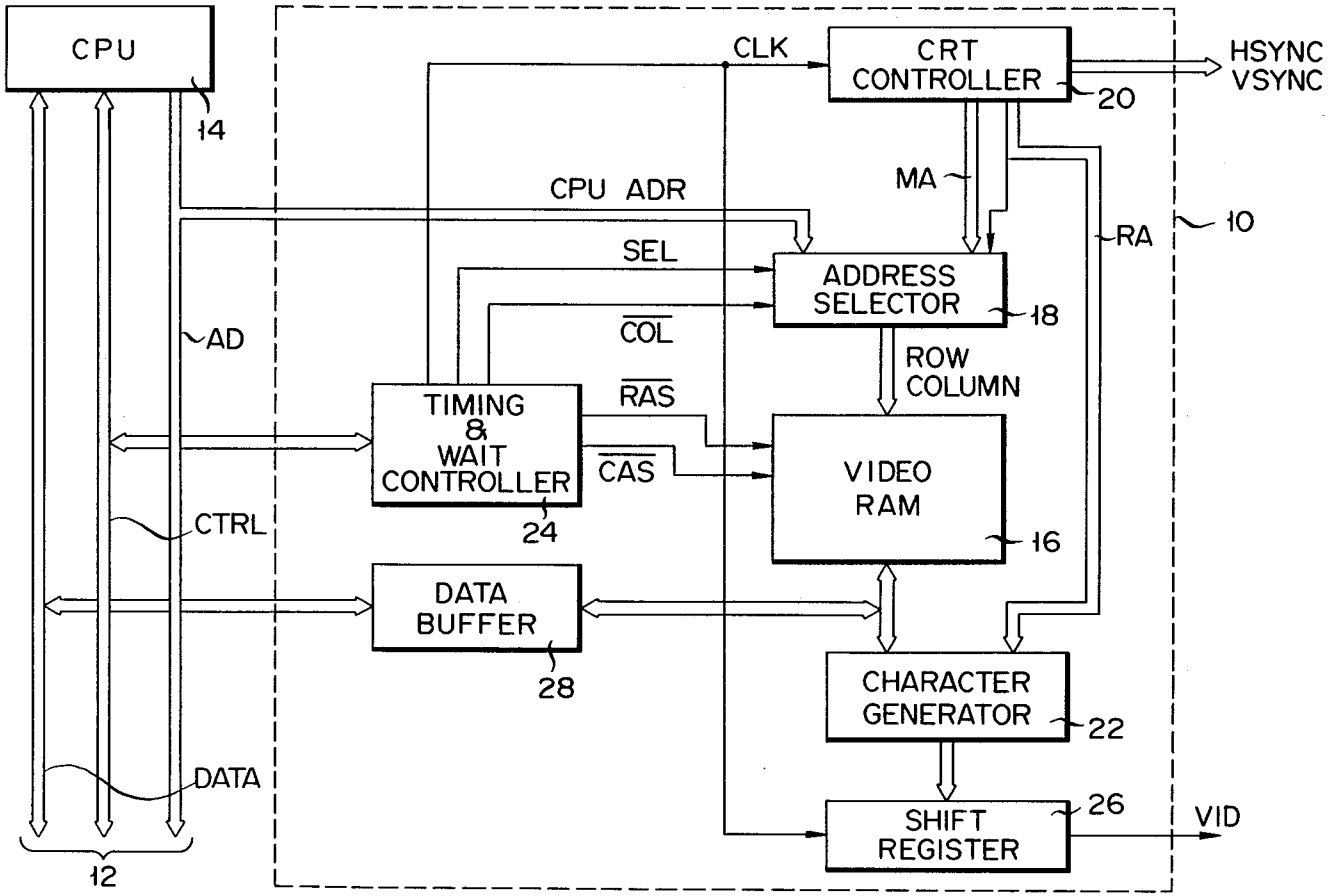
FIG. 1 is a block diagram of a computer system including a first embodiment of a display control circuit according to the invention.

An embodiment of a display control circuit according to the invention will be described with reference to the accompanying drawings. FIG. 1 shows a block diagram of a computer system mainly based on the display control circuit 10 of a first embodiment. The circuit 10 is connected to a central processor unit (CPU) 14 through a system bus 12. CPU 14 controls the whole system. The system bus 12 is comprised of an address bus AD, a control bus CTRL and a data bus DATA. The display control circuit 10 synchronizes a video RAM (VRAM) 16 and its peripheral circuit with a CRT display unit (not shown). VRAM 16 stores 2048 characters represented by ANK character codes. Since an ANK code is an 8-bit code, it is sufficient for VRAM 16 to have a 2Kb-capacity. However, the VRAM 16 has a 4Kb-capacity (described later. A writing address CPU ADR is supplied from CPU 14 to a first input terminal of an address selector 18. CPU ADR accesses the VRAM 16 of 4Kb so that the bit length of CPU ADR is 14 bits. A raster address RA and a refresh memory address MA are generated from a CRT controller (CRTC) 20 to output display data from the VRAM 16 to the CRT display unit. CRTC 20 further generates a horizontal synchronizing signal HSYNC and a vertical synchronizing signal VSYNC. The memory address MA is a memory address signal for refreshing a video frame displayed on the CRT display unit for a predetermined period. The memory address MA is 11 bits long. The raster address RA is supplied to a character generator 22 and used as a raster selection signal which selects a character pattern of one raster component. The memory address MA and the least significant bit of the raster address RA are supplied to a second input terminal of the address selector 18. A timing & wait controller 24 produces a character clock (CLK) determining the timing of the RA, MA, HSYNC and VSYNC and supplies it to CRTC 20. The timing & wait controller 24 supplies an address selection signal SEL and a column selection signal $\overline{COL}$ to the address selector 18. One of the CPU ADR and MA is selected by the address selection signal SEL. The output signal from the address selector 18 is divided into a row address and a column address according to the column selection signal $\overline{COL}$ and the divided one is supplied to the VRAM 16. The timing & wait controller 24 supplies a row address selection signal ($\overline{RAS}$) and a column address selection signal ($\overline{CAS}$) to VRAM 16. The video RAM 16 decodes the row address in response to the $\overline{RAS}$ and decodes the column address in response to the $\overline{CAS}$. VRAM 16 includes a row address decoder and a column address decoder. The character code read from VRAM 16 to be displayed is supplied to the character generator 22. The character generator 22 produces a pattern data of one raster corresponding both to the character code and raster address RA. This pattern data is supplied to a shift register 26 and converted to a serial dot signal VID.

The VRAM 16 is accessed by the CPU 16 when an access request is supplied to the timing & wait controller 24 through the CRT controller 20. If the video RAM access achieved by CRTC 20 comes into collision with the video RAM access achieved by CPU 14, the timing & wait controller 24 sets CPU 14 in waiting mode. When the waiting mode ends, CPU 14 produces the CPU ADR through the address bus AD. When the character codes are written into the VRAM 16, the data is stored in a data buffer 28. At this time, the timing & wait controller 24 produces an address selection signal SEL, which causes the address selector 18 to select the CPU ADR.

According to this embodiment, the memory address and the bit 0 of the raster address RA MA are combined to form a video RAM access address, with the RA being used as the least significant bit. Therefore, the video RAM access address for display is a 12-bit address. The upper six bits of the access address and the lower six bits of the access address are supplied to the VRAM 16 as the row address and the column address respectively, as shown in FIGS. 2A and 2B.

For example, in the case where VRAM 16 for displaying 2048 characters on the CRT display unit includes a 2kb-capacity DRAM which comprises a memory cell matrix of 64 rows by 32 columns, all of the 64 row addresses of the DRAM must be accessed or completely refreshing the cell matrix of VRAM 16. It is assumed that CRTC 20 supplies only the 11-bit memory addresses MA to VRAM 16, wherein the lower six bits of memory address MA are supplied thereto as the row address and the upper five bits are supplied as the column address, as in the conventional display control circuit. In this case, when 64 characters are displayed in one row, since the value of the lower six bits of memory addresses MA changes from 1 through 64 and the 64 row addresses are all accessed within the period for displaying one scanning line of one row, all the memory cells are refreshed within this period. However, if 32 characters are displayed in one row, the value of the lower 6 bits changes only from 1 through 32 within the one scanning period. For displaying respective raster dot patterns of any 32 characters in one row, the same 32 addresses are repeatedly supplied to VRAM 16 for every scanning line included in the row. And so, the most significant bit of the lower six bits remains unchanged in one row displaying period and only 32 row addresses of VRAM 16 are accessed. When another 32 characters in the next row are displayed, the most significant bit changes and the remaining 32 row addresses are accessed. So, in this case, it takes a period from when the first scanning line in one row is scanned through when the first scanning line in the next row is scanned to access all row addresses of VRAM 16. Therefore, if the number of rasters per row increases, since this period becomes longer, all the memory cells cannot be refreshed within a predetermined period of time. This embodiment solves this problem in the conventional display control circuit. Therefore, if the number of rasters per row increases, all the memory cells can not be refreshed within a predetermined period of time.

According to this embodiment, the bit 0 of the raster address RA is included in the row address. 64 row addresses are accessed within a 2-raster period. Therefore, even when 32 digits are displayed in one row, 64 row addresses are refreshed within a 2-raster period. Moreover, the refresh period is not prolonged with increase of the number of rasters per row. In this embodiment, however, the same character code must be stored in the succeeding two addresses of VRAM 16. This is because the same character code must be read from VRAM 16 when the bit 0 of the RA is "1" and when the bit 0 of the RA is "0".

In this embodiment, the addressing space of VRAM 16 must be increased and the same character code must be written into the increased space. Nevertheless, the embodiment has the advantage that the refresh period of the video RAM is greatly shortened.

The number of bits forming raster address RA used for the row address, or the positions of these bits are not limited to those specified above. For instance, the bits of address RA can be the intermediate bits of the row address.

A second embodiment in which character codes and dot patterns are mixed stored in the video RAM will be described.

FIG. 3 is an apparent address map of the video RAM according to the second embodiment. The address for the cell matrix is called a physical address. The apparent address is called a logic address to distinguish it from the physical address. One word of the video RAM 16 is of 9 bits. The bit 8 of the word is a control bit for indicating that the remaining eight bits form pattern data or a character code. The capacity of the video RAM 16 is 16 KW (words) and distributed in 2 KW units according to the raster address. The video RAM 16 is comprised of 9 row refresh type dynamic RAM chips each of 16 Kb (128 rows by 128 columns). When the character codes are written into the video RAM, the same character codes are written into the respective 2 KW areas of the video RAM. Three bits of the raster address RA are supplied to VRAM 16; the number of rasters per row if 8. 11 bits of the memory address MA are supplied to the video RAM. The logical address must have the format shown in FIG. 4 to realize the logical address map as shown in FIG. 3. The 3-bit raster address RA is assigned to the upper three bits of the logical address and the 11-bit memory address MA is assigned to the lower 11 bits of the logical address. If the bit 0 (LSB) to bit 6 of the logical address are supplied to VRAM 10 as the row address and the bit 7 to bit 14 of the logical address (i.e., the bit 7 to bit 10 of the memory address MA and the bit 0 to bit 2 of the raster address RA) are supplied as the column address, the following drawback will occur. Since the eight rasters constitute one display row, the time period necessary to display one row is 512 (64×8) μsec. Almost 4 rows are displayed in 2 msec. The number of physical addresses accessed within 2 msec is 4 times the number of digits per row. The complement of the refresh means that 128 row addresses are accessed in 2 msec. It is therefore sufficient that the number of digits per row is not less than 32. If the number of digits per row is less than 32, there will be no margin of the refresh cycle and it is not possible to refresh the memory cells.

To solve this problem, the bits constituting the words defined by the address map shown in FIG. 3 are separately stored in the memory cell matrix of the RAM chip. That is, the row address and the column address (physical address) supplied to the RAM chip are obtained by rearranging the bit location of the logical address shown in FIG. 4.

Figure 5:
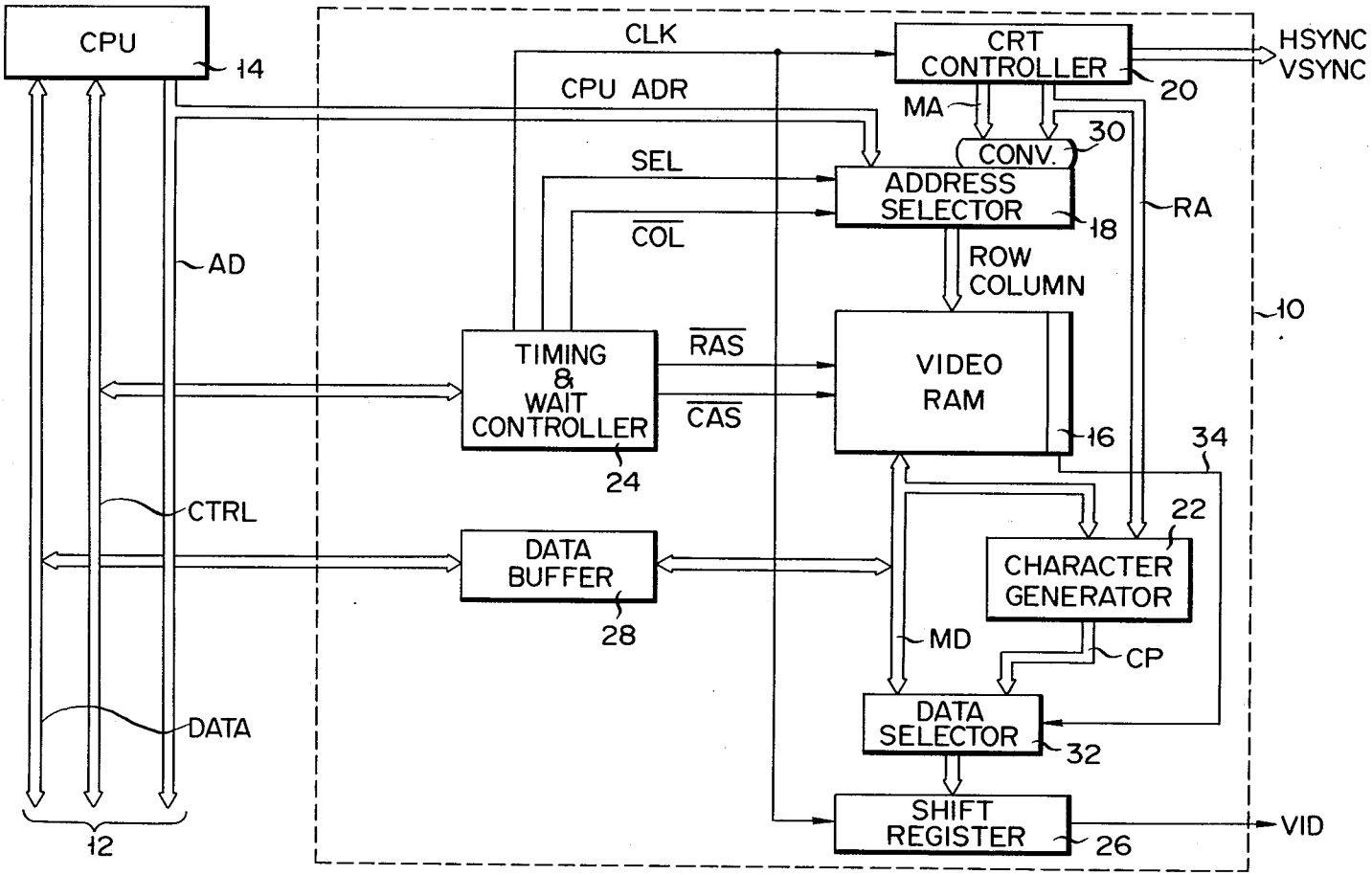
FIG. 5 is a block diagram of a computer system including the second embodiment of the display control circuit according to the invention.

FIG. 5 is a block diagram of a computer system mainly based on the display control circuit according to the second embodiment. The same reference numerals as used in FIG. 1 will be used in FIG. 5 to denote corresponding portions. The second embodiment is a modification of the first embodiment, which further comprises an address converter (CONV) 30, a data selector 32 and a signal line 34. The video RAM 16 stores the dot pattern data and the character code in a mixed form. The data selector 32 selects one of the data MD from the video RAM 16 and the character pattern data CP from the character generator 22 and the selected one is supplied to the shift register 26. The selection of the data controller 32 is controlled by the bit 8 (the control bit) of the word in VRAM 16 through the signal line 34. The output timings of the data MD and CP are different from each other, so it is necessary to correct the timings of the data MD and CP. However, the timing correction has no direct relevancy to this invention. The description thereof is omitted. The address converter 30 is described as a bit-permutating means of the memory address MA and the raster address RA. The address converter 30 is realized by changing the connections between the MA, RA output terminals of the CRT controller 20 and the input terminals of the address selector 18.

According to the second embodiment, the row address and the column address which are produced from the address selector 18 for accessing VRAM 16 to display have the bit-arrangements as shown in FIGS. 6A and 6B, respectively. The bits 0 and 1 of the raster address RA and the bits 0 to 4 of the memory address MA are assigned to the row address. The bit 2 of the raster address RA and the bits 5 to 10 of the memory address MA are assigned to the column address. In this embodiment, since VRAM 16 utilizes a multi-addressing system, the row address and the column address are alternatively supplied to VRAM 16 according to the column selection signal $\overline{COL}$. The row address selection signal $\overline{RAS}$, the column selection signal $\overline{COL}$, the column address selection $\overline{CAS}$ and the VRAM access (physical address) are shown by the timing charts of FIGS. 7A, 7B, 7C and 7D.

The raster address RA included in the row address is changed for each raster. The row addresses RA are all accessed in a display period of 32 ($=2^5$) digits and 4 rasters, because the memory address MA is of 5 bits. Therefore, if more than 32 digits are displayed in one row, all the row addresses are accessed in a 4-raster period, i.e., 64×4=256 μsec. The memory cells of 16 Kb are all refreshed in that period. If the number of rasters per row and the number of bits of the raster address RA increase, the number of bits of the memory address MA will decrease. However, the row address shown in FIG. 6A can be formed when one row has 32 or more digits and the refresh is completed in 256 μsec.

Namely, according to this embodiment, the physical address used to conduct the reading operation for refreshing the video RAM, i.e., row addresses, is formed of a lower bit portion of the raster address and a lower bit portion of the memory address, whereby the refreshing of the VRAM, as a whole, is completed in a smaller number of raster cycles. Thus, the refreshing is possible, even when the construction of the display screen is disadvantageous for the refreshing operation, namely, even when the number of rasters per row increases.

Further, even when the environmental conditions of the video RAM change with the result that the refreshing cycle is shortened, the refreshing of the video RAM is reliably executed.

In the second embodiment, 2 bits of the raster address are assigned to the row address. The number of raster addresses assigned to the row address is not limited to two; 3 or more bits may be allotted to the row address. FIGS. 8A and 8B show an example of a row address and a column address in which the row address includes all of the raster address 3 bits. Since the row address is comprised of the bits 0 to 2 of the raster address and the bits 1 to 4 of the memory address, the refreshing of the video RAM is completed in an 8 ($=2^3$)-raster period, i.e., a period of 512 μsec. if one row consists of 32 or more digits. Note here that the raster address is not always required to be assigned to the lower bit location of the row address.

The writing of data into the VRAM 16 occurs as follows. When CPU 14 supplies a memory request signal to the timing & wait controller 24, timing & wait controller 24 may access CPU 14. CPU 14 supplies CPU ADR (writing address) to the address selector 18 and the write data to the data buffer 28. CPU ADR is a physical address to write data into the VRAM 16.

What is claimed is:

1. A display control circuit comprising:

a video RAM for storing data representing images to be displayed on a screen which is divided into characters or digits arranged in a matrix, a character or digit being comprised of several scanning lines;

read controller means for generating a reading address of said video RAM inlcuding a raster address specifying a scanning line in a character or digit and a memory address representing a position of said character or digit on said screen; and, means, coupled to said controller means and said video RAM, for converting said reading address generated by said read controller means into a row address and a column address of said video RAM such that said row address includes at least a part of said raster address, said converting means providing said row address and said column address to said video RAM for reading said data out of said video RAM.

2. A display control circuit as in claim 1, wherein said data are character codes representing character images to be displayed.

3. A display control circuit as in claim 1, wherein said data are dot-pattern data in each of which one bit corresponds to one dot on the screen.

4. A display control circuit as in claim 1, wherein:

said video RAM comprises dynamic memory chips for storing character codes, each code representing a character image displayed on the screen, and each chip having memory cells of $2^N$rows by $2^I$ columns, where N and I are positive integers;

said converting means assigns at least P bits of said raster address and (N-P) bits of the memory address to said row address and the remaining memory address to said column address, where P is a positive integer, where $2^P \geqq 2^N/M$, and M represents the number of characters per row of the screen;

a row address space of said video RAM is divided into $2^P$areas by said P bits of the raster address; and character codes to be displayed are stored in the location designated by the memory address in one of the areas designated said P bits of the raster address, and further comprises a character generator for generating dot-pattern data according to the raster address and the character code read out of a location designated by the memory address in one of said areas designated by said P bits of the raster address.

5. A display control circuit as in claim 4, further comprises means for generating a row address selection signal and a column address selection signal, and wherein said video RAM decodes the row address applied thereto in response to the row address selecting signal and also decodes the column address applied thereto in response to the column address selecting signal.

6. A display control circuit as in claim 4, further comprising means for converting the dot-pattern data into a serial dot signal to be supplied to a display.

7. A display control circuit as in claim 1, wherein:

said video RAM comprises one or more dynamic memory chips for storing data in which one bit corresponds to one dot on said screen, each having memory cells of $2^N$rows and $2^I$columns, where N and I are positive integers;

a logical address space of said video RAM is divided into $2^P$areas, each corresponding to one scanning line in each digit by P-bit raster addresses, where P is a positive integer;

one row of said screen which includes $2^P$ scanning lines is comprised of $2^M$ digits, where M is a positive integer; and said converting means assigns lower m bits of said memory address and (N-M) bits of said P-bit raster address to the row address and also assigns remaining bits of the memory address and the raster address to the column address.

8. A display control circuit as in claim 7, further comprising means for generating a row address-selecting signal and a column address-selecting signal, and wherein said video RAM decodes the row address in response to the row address-selecting signal and also decodes the column address in response to the column address-selecting signal.

9. A display control circuit as in claim 8, further comprising means for converting data read out of the video RAM into a serial dot signal to be supplied to a display.

10. A display control circuit as in claim 1, wherein:

said video RAM stores character codes representing a character image and dot data, in which one bit corresponds to one dot on the screen, each location in said video RAM having a flag for determining whether a data stored therein is a character code or a dot data, and further comprising;

a character generator for generating dot-pattern data according to a character data read out of a location of said video RAM, which is designated by the row and column address applied by said converting means, when the flag in the location shows the data stored therein is a character code; and means for selecting the dot-pattern data generated by the character generator when the flag shows that a data stored in the location is a character code and also selecting dot data read out of the location of the video RAM when the flag shows that a data stored in the location is a dot data.

11. A display control circuit as in claim 10, further comprising means for converting the dot-pattern data or the dot data selected by the selecting means into a serial dot signal to be supplied to a display.

12. A display control circuit as in claim 10, further comprising means for generating a row address-selecting signal and a column address signal, and wherein said video RAM decodes the row address applied thereto in response to the row address-selecting signal and also decodes the column address-signal applied thereto in response to the column address-selecting signal.

* * * * *